US007794507B2

(12) United States Patent
Bishop et al.

(10) Patent No.: US 7,794,507 B2
(45) Date of Patent: Sep. 14, 2010

(54) TEXTILE TREATMENT

(75) Inventors: David Paul Bishop, Wirral (GB); Joao Marques Cortez, Leicester (GB); John Ellis, Duffield (GB)

(73) Assignee: Devan-PPT Chemicals Limited, Derby (GB)

( * ) Notice: Subject to any disclaimer, the term of this patent is extended or adjusted under 35 U.S.C. 154(b) by 0 days.

(21) Appl. No.: 12/218,318

(22) Filed: Jul. 14, 2008

(65) Prior Publication Data

US 2009/0007344 A1 Jan. 8, 2009

Related U.S. Application Data

(63) Continuation of application No. 10/182,102, filed as application No. PCT/GB01/00227 on Jan. 22, 2001, now abandoned.

(30) Foreign Application Priority Data

Jan. 22, 2000 (GB) ..... 0001388.8

(51) Int. Cl.
*C11D 3/00* (2006.01)
*C12S 9/00* (2006.01)
*C12N 7/04* (2006.01)

(52) U.S. Cl. ..... 8/137; 435/209; 435/236; 510/283; 510/284; 510/305; 510/311; 510/320; 510/321; 510/357; 510/392; 510/393; 510/490; 8/102; 8/107

(58) Field of Classification Search ..... 8/102, 8/107, 137; 510/320, 321, 392, 393, 283, 510/284, 305, 311, 357, 490; 435/209, 236
See application file for complete search history.

(56) References Cited

U.S. PATENT DOCUMENTS

| | | | | |
|---|---|---|---|---|
| 4,738,682 | A | 4/1988 | Boegh et al. | |
| 5,120,463 | A | 6/1992 | Bjork et al. | |
| 5,366,510 | A | 11/1994 | Wasinger et al. | |
| 5,858,767 | A * | 1/1999 | Miettinen-Oinonen et al. | 435/263 |
| 5,874,293 | A * | 2/1999 | Miettinen-Oinonen et al. | 435/263 |
| 5,922,083 | A | 7/1999 | Biscarini et al. | |
| 6,451,063 | B1 | 9/2002 | Clarkson et al. | |

FOREIGN PATENT DOCUMENTS

| | | |
|---|---|---|
| EP | 0 736 597 | 10/1996 |
| EP | 0 911 441 | 4/1999 |
| WO | WO 98/53131 | 11/1998 |
| WO | WO 99/32708 | 7/1999 |
| WO | WO 99/60199 | 11/1999 |

OTHER PUBLICATIONS

Kumar, Akhil, et al., "Optimizing the Use of Cellulase Enzymes in Finishing Cellulosic Fabrics," *Textile Chemist and Colorist*, Apr. 1997, pp. 37-42.

* cited by examiner

*Primary Examiner*—Vasu Jagannathan
*Assistant Examiner*—Preeti Kumar
(74) *Attorney, Agent, or Firm*—McDermott Will & Emery LLP

(57) ABSTRACT

There is disclosed a method for treating textiles comprising applying to the textile an enzyme having a specific activity towards the textile, under conditions such that there is substantially no mechanical agitation.

13 Claims, 1 Drawing Sheet

Percentage improvement (relative to a control treated only with buffer) in dimensional stability v percentage tear strength loss (in the warp direction)

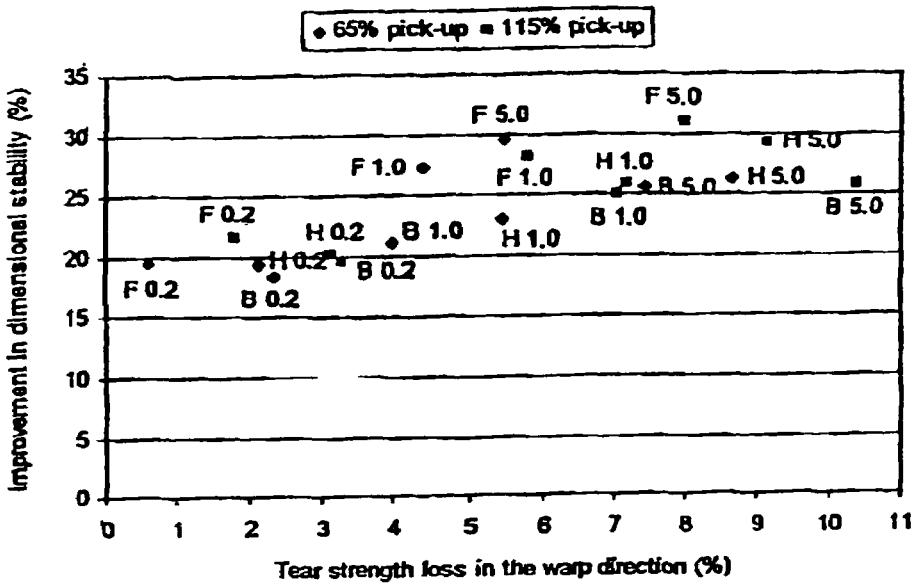
Figure 1 - Percentage improvement (relative to a control treated only with buffer) in dimensional stability v percentage tear strength loss (in the warp direction)
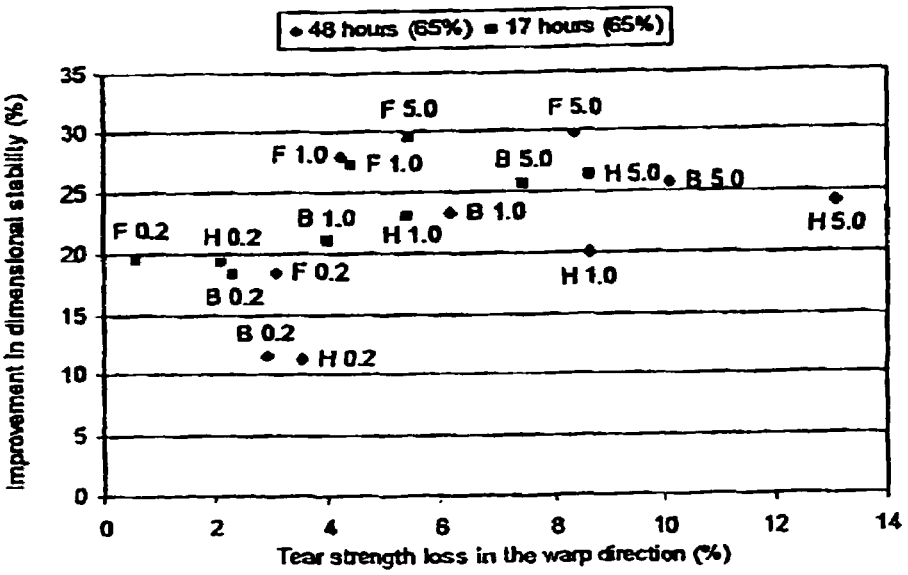
Figure 2 - Percentage improvement (relative to a control treated only with buffer) in dimensional stability v percentage tear strength loss (in the warp direction)

TEXTILE TREATMENT

CROSS-REFERENCE TO RELATED APPLICATIONS

This application is a continuation of U.S. application Ser. No. 10/182,102, filed Apr. 11, 2003 now abandoned, which is a U.S. National filing under §371 of International Application No. PCT/GB01/00227, filed Jan. 22, 2001, which claims priority from British Application No. 0001388.8, filed Jan. 22, 2000, all of which are incorporated herein by reference.

FEDERALLY SPONSORED RESEARCH OR DEVELOPMENT

Not Applicable.

TECHNICAL FIELD

This invention relates to methods for treating textiles, and, more particularly to treating textiles with enzymes.

BACKGROUND OF THE INVENTION

Enzymes are widely used in textile treatments, for example in industrial processing such as desizing of cloth and stone-washing of denim, or to impart enhanced fabric properties such as pilling properties and hand. Enzymes are also used in domestic laundry products to assist in cleaning soiled and stained fabrics and to counter the appearance of surface fibre. In particular, cellulases have been used to treat cellulosic, particularly cotton goods and specific enzyme activities can be tailored for producing specific effects, whilst reducing or avoiding deleterious effects.

Enzyme treatment is carried out on textiles using a variety of methods and machinery. Rotary dyeing machines, winches, jet dyeing machines and drum washers are all in widespread use and have the common feature that the textile is subjected to a high degree of agitation over a prolonged period of time. Many of the more desirable effects, such as defibrillation are only fully achievable when the textile is subject to significant mechanical action and even abrasion during processing.

Treatment conditions during enzyme treatment are carefully controlled, both as to pH and temperature. Generally, treatment is carried out at somewhat elevated temperature, around 45-55.degree. C., in a solution of which the pH is in the range 4.8-5.5 for acid cellulase systems, or 4.8-8 for neutral enzymes.

Enzyme treatment of cellulosic goods invariably leads to a reduction, even if only a slight reduction, in fabric properties such as tensile or tear strength, and there is also a measurable weight loss involved, which is partly due to the mechanical agitation involved in the processing.

SUMMARY OF THE INVENTION

The present invention provides new processes for textiles, notably cellulosic textiles such as cotton and flax, which enhance their properties in ways not previously contemplated in the context of enzyme treatment, and which do not adversely affect textile properties to the same extent as conventional enzyme treatment.

The invention comprises, in one aspect, a method for treating textiles comprising applying to the textile an enzyme having a specific activity towards the textile under conditions such that there is substantially no mechanical agitation.

An enzyme-containing composition may be applied to the textile by soaking or by padding, for example. The enzyme composition may be left in contact with the textile for an extended period of time under ambient conditions, for example, for five hours or more, even up to ten or twenty hours.

The textile may subsequently be washed to remove unreacted enzyme.

An important effect of this treatment is to improve the dimensional stability particularly of cotton and other cellulosic fabrics, such as flax, and viscose rayon. Enzymes found to be particularly useful in this regard are cellulases such as Biotouch L, cellulase F or cellulase H, all commercially available from Rohm Enzyme Finland OY, or mixtures or any two or all three thereof. Other enzymes, some yet to be developed, will be found useful, these, however, being the most advantageous investigated to date.

The enzyme may be applied at an add-on of 0.1 to 10 mg total protein per gram of textile.

The textile may comprise more than one fibre type, and may indeed comprise blends of cellulosic and non-cellulosic fibres, for example cotton-polyester blends. Where more than one fibre type is involved, the enzyme system may comprise more than one enzyme so as to have specific activities specific activity towards different fibres types.

Textiles which can be treated include woven and knitted fabrics as well as non-wovens and even yarns. Fabrics may be treated by cold batch padding, the treatment being carried out over prolonged periods, or simply by soaking. Yarns may be treated on hank or shein or even on the package, just being left to soak at room temperature for up to twenty hours or longer.

After the enzyme treatment is finished, the cellulolytic reaction may be stopped by immersing the textile in a 5% solution of sodium carbonate, and the textile may then be rinsed, for example, three times, with agitation, then dried in whatever manner is appropriate.

BRIEF DESCRIPTION OF DRAWINGS

FIG. 1 is a graph showing the percentage improvement in dimensional stability versus percentage tear strength in the warp direction of an RS fabric batched for 17 hours with a 0.2, 1.0 and 5.0 mg of Biotouch L, cellulase F and cellulase H per gram of fabric at different pick-up rates;

FIG. 2 is a graph showing the percentage improvement in dimensional stability versus percentage tear strength in the warp direction of an RS fabric batched for 17 and 48 hours with a 0.2, 1.0 and 5.0 mg of Biotouch L, cellulase F and cellulase H per gram of fabric at pick-up rate of 65%.

DETAILED DESCRIPTION

The invention will now be described with reference to the following Examples:

EXAMPLE 1

The cellulases Biotouch L (a Trichderma reesei secreted cellulase, commercially available from Rohm Enzyme Finland OY), cellulase F and cellulase H (from the same supplier) were applied to a 100% cotton fabric woven from ring spun yarns (205 g/m) with a heavy-duty padder. Each enzyme was applied in solution at three different add-ons, namely 0.2, 1.0 and 5.0 mg of total protein per g of fabric, and was buffered with 0.1M acetate buffer, pH adjusted to 5.0 with sodium hydroxide. The pick-up rate was (65.+−0.5) % (percentage weight of enzyme liquor per weight of fabric). The fabrics were then rolled up and kept rotating for 17 hours at ambient temperature (approx. 20.degree. C.). The cellulolytic reaction was then stopped by immersion in a 5% solution of sodium carbonate and the fabric rinsed in three consecutive cycles, without detergent, the first rinse in water at approximately 60.degree. C., agitated for 10 minutes, the second in warm water (40.degree. C.) agitated for five minutes, the third in cold water, agitated for five minutes, after which the fabrics were dried.

Dimensional stability of the fabrics to further washing was determined on the basis of area change by the method ISO 5077:1984, the enzyme treatments being compared to a buffer treated control. Three samples of each of the treated fabrics were washed in a domestic washing machine with ECE standard detergent on a 40.degree. C. cycle for up to ten times, each wash being followed by tumble drying for 70 minutes. Tear strength tests (Marks & Spencer tear strength method) were also carried out.

There was a significant improvement in the dimensional stability on all cellulase treated fabrics compared to the buffer treated control. The greater improvements in dimensional stability were obtained with cellulase F; treatments with cellulases Biotouch L and H gave lower dimensional stability with greater loss in fabric strength. The treatment with 5.0 mg of cellulase F/g of fabric at 65% pick-up resulted in an improvement in shrinkage of about 29% with a loss of strength of about 5.5%. The results are summarised in FIG. 1.

EXAMPLE 2

As for Example 1, but with the fabric being rotated for 48 hours instead of 17 hours. Again, cellulase F gave best results, but the prolonged reaction time resulted in considerably higher strength losses with little or no improvement in shrinkage—see FIG. 2.

EXAMPLE 3

On denim fabrics, the treatments according to Example 1 showed cellulase F, again, to give best results, a lighter denim fabric having an improvement in shrinkage of about 25% with a strength loss of only 4.5%, a heavier fabric registering an improvement in shrinkage of about 35% with a loss of strength of only 3.3%.

EXAMPLE 4

A cotton interlock fabric treated as in Example 1, but with a pick-up rate of 80% showed with cellulase F at 5.0 mg/g an improvement in shrinkage of about 53% with a strength loss of 6.1%.

EXAMPLE 5

A 50%/50% cotton/polyester bed linen fabric treated as in Example 1 at 70% pick-up showed a 53% improvement in shrinkage on treatment with cellulase F (5.0 mg/g) with a loss of strength of 5%.

EXAMPLE 6

A 100% viscose fabric treated as in Example 1 showed a 30% improvement in shrinkage with a strength loss of about 6.3% when treated with cellulase F at 50 mg/g.

Generally speaking, cellulase F outperformed cellulases Biotouch L and H, though they too showed useful improvements in shrinkage with somewhat greater loss of strength. Clearly, different enzymes will have different effects on different fibres, and other enzymes may yet be discovered to outperform cellulase F.

Treatment with enzymes without agitation for the purpose of improving dimensional stability may be carried out as a pre- or post-treatment to treatment with other enzymes for improving other properties under the usual elevated temperature and agitation conditions.

The method may not be limited to cellulosic fibres. Enzymes exist that have effect on other natural fibres, such as wool, and enzymes may be found to have similar effects on synthetic fibres.

EXAMPLE 7

Bleached ecru cotton yarn ({fraction (1/20)} Nm count) was wound onto a dye spindle for a Pegg yarn package sample dyeing machine. Four spindles were prepared, three for treatment with enzyme, the other as a control.

The prepared control yarn package was loaded in the sample dyeing machine. Water containing sodium acetate buffer to give a pH value of 5.0-5.5 (prepared from acetic acid and sodium hydroxide) was circulated at 40.degree. C. The machine was set to automatically reverse the flow through the package every five minutes, and the treatment was continued for eight hours. At the end of the treatment process, the yarn package was rinsed in a solution of sodium carbonate (at a concentration of 1 g/l) at 80.degree. C. for ten minutes, then rinsed twice with warm (50.degree. C.) water and cold water. The yarn package was removed and dried in a radio-frequency dryer.

Further yarn packages were treated as above, but a quantity of Enzyme F was included in each treatment, equivalent to 0.2, 1.0, 5.0 mg enzyme protein/g of yarn. Each treatment was carried out as described above.

The dried yarns were knitted on a hand-knitting machine to give suitable fabrics. The dimensions of each fabric square were measured before and after washing and tumble drying in a domestic washing machine. The treated fabrics showed a significant reduction in dimensional change (shrinkage) amounting to 10%, 15% and 32% respectively for the treatment levels 0.2, 1.0, 5.0 mg protein /g yarn.

What is claimed is:

1. A method for treatment of a fabric comprising a cellulosic fibre, the method comprising the steps of:

applying to the fabric an industrial treatment composition comprising a cellulase applied at an add-on of 0.1 to 10 mg total protein per g of fabric and at a pH in the range of 4.8 to 5.5, contacting the composition with the fabric with substantially no mechanical agitation for at least five hours, such that the fabric exhibits improvement in shrinkage when subsequently washed.

2. A method according to claim 1, in which the composition is applied to the fabric by soaking.

3. A method according to claim 1, in which the composition is applied to the fabric by padding.

4. A method according to claim 1, in which the composition is left in contact with the fabric for between 10 and 20 hours.

5. A method according to claim 1, in which the fabric is washed to remove unreacted cellulase.

6. A method according to claim 1, in which the fabric comprises a natural cellulosic fibre such as cotton or flax.

7. A method according to claim 1, in which the fabric comprises a man-made cellulosic fibre such as rayon.

8. A method according to claim 1, in which the fabric comprises more than one fibre type.

9. A method according to claim 1, in which the fabric comprises a woven fabric.

10. A method according to claim 1, in which the fabric comprises a knitted fabric.

11. A method for treatment of a cellulosic fibre, the method comprising the steps of :

applying to the fibre an industrial treatment composition comprising a cellulase, cellulase applied at an add-on of 0.1 to 10 mg total protein per g of fibre, and at a pH in the range of 4.8 to 5.5, contacting the composition with the fibre with substantially no mechanical agitation for at least five hours, such that the fibre exhibits improvement in shrinkage when subsequently washed.

12. The method according to claim 11 wherein the fibre comprises a yarn.

13. The method according to claim 11 wherein the fibre is used to knit a fabric.

* * * * *